US005347253A

United States Patent [19]

Ogikubo

[11] Patent Number: 5,347,253

[45] Date of Patent: Sep. 13, 1994

[54] ATTRACTING BODY UTILIZING MAGNET

[75] Inventor: Konomu Ogikubo, Saitama, Japan

[73] Assignee: MagX Co., Ltd., Tokyo, Japan

[21] Appl. No.: 95,212

[22] Filed: Jul. 23, 1993

[30] Foreign Application Priority Data

Apr. 12, 1993 [JP] Japan ..... 5-108866

[51] Int. Cl.[5] ..... H01F 7/02; A63H 33/04; A63H 33/26; A63F 3/00

[52] U.S. Cl. ..... 335/302; 335/306; 446/92; 446/137; 273/239

[58] Field of Search ..... 335/302, 306, 292; 446/92, 101, 137, 138, 131; 273/456, 239, 142 JB

[56] References Cited

U.S. PATENT DOCUMENTS

| | | | |
|---|---|---|---|
| 2,570,625 | 10/1951 | Zimmerman | 46/24 |
| 3,059,910 | 10/1962 | Moriya | 261/72 |
| 3,406,363 | 5/1966 | Tate | 335/302 |
| 3,411,120 | 11/1968 | Miyata | 335/302 |
| 3,982,334 | 9/1976 | Tate | 35/66 |
| 4,238,905 | 12/1980 | McGraw | 46/25 |
| 4,334,870 | 6/1982 | Roane | 434/211 |
| 4,741,534 | 5/1988 | Rogahn | 273/157 R |
| 5,057,363 | 10/1991 | Nakanishi | 428/321.5 |
| 5,127,652 | 7/1992 | Unger | 273/157 R |

FOREIGN PATENT DOCUMENTS

| | | | |
|---|---|---|---|
| 975011 | 7/1961 | Fed. Rep. of Germany | 335/306 |
| 3190108 | 8/1991 | Japan | 335/302 |

*Primary Examiner*—Leo P. Picard
*Assistant Examiner*—Stephen T. Ryan
*Attorney, Agent, or Firm*—Wenderoth, Lind & Ponack

[57] ABSTRACT

A non-magnetic case 3 made of acrylic acid or like synthetic resin has a case body 3*a*, a lid 3*b* and a right hexahedron shape. The case body 3*a* has a substantially spherical accommodation space 3*c* in which a spherical magnet body 2 having paired N and S poles arranged in a uni-axial direction is sealed together with oil or a like transparent liquid having a high specific gravity and also having a considerably high viscosity to provide buoyancy to the magnet body 2 and facilitate the rotation thereof with a lubricating action. The clearance between the magnet body 2 and the wall surface of the accommodation space 3*c* is set to be small such that the magnet body 2 can be rotated smoothly. The case 3 with the magnet body 2 therein is applicable to combination toys such as toy blocks and puzzle sets or various attracting articles having mutual attraction requirement. The thickness of a central portion of each side wall of the case is reduced to facilitate the attraction of the magnet bodies to each other.

8 Claims, 4 Drawing Sheets

ATTRACTING BODY UTILIZING MAGNET

BACKGROUND OF THE INVENTION

A magnet can be attracted to a magnetic body in any direction with no respect to its polarity. However, when causing mutual attraction of magnets each having paired N and S poles in a uni-axial direction, the mutual positional relation of the magnets is determined absolutely such that the mutually attracted surfaces form a pair of N and S poles.

For example, with two magnets each having paired N and S poles in one unit-axial direction, the two N or S poles of the two magnets repel each other, although the N or S pole of one magnet and the S or N pole of the other attract each other. Further, side surfaces of these magnets other than those of the N and S poles attract each other. However, if the N and S poles are located in like directions of each side surface, repulsion of the poles results.

Meanwhile, in the design of combination toys such as toy blocks and puzzles, in which component members or elements are required to be assembled accurately in desired positions, or in various attracting articles for meeting temporary or permanent mutual attraction requirements, it can be thought to make use of and obtain the attraction of magnets that are adequately disposed or accommodated in appropriate relation to one another. However, as noted above, the polarity of magnets imposes restrictions on the attraction of magnets to desired positions.

SUMMARY OF THE INVENTION

An object of the invention is to provide an attracting body utilizing a magnet which permits utilization of magnets for combination toys such as toy blocks and puzzle sets, with which the element blocks or members can be mutually attracted, and also for various attracting articles meeting mutual attraction requirements such that the mutual attraction of elements to desired positions can be obtained in any positional relation of the magnets with no regard to the polarity of the magnets.

DETAILED DESCRIPTION OF THE PREFERED EMBODIMENT

Figure 1:
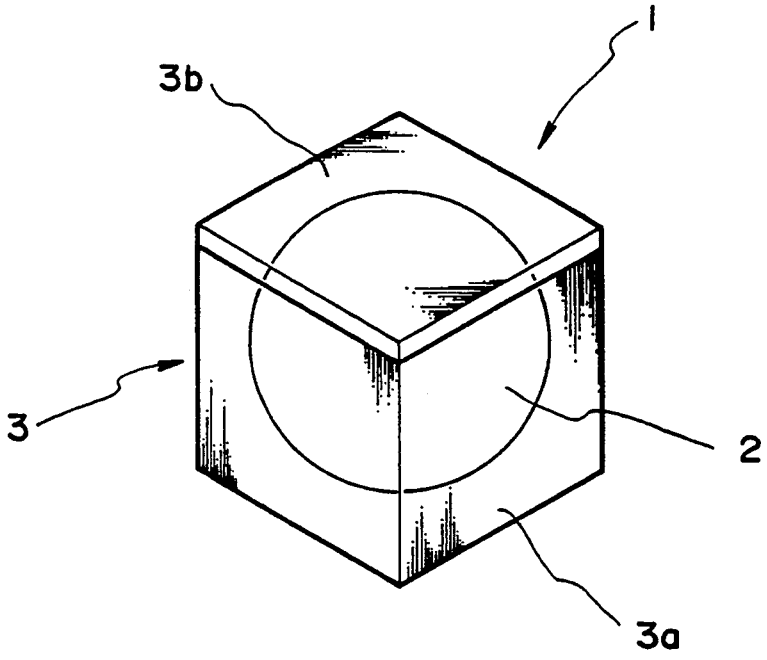
FIG. 1 is a perspective view showing a first embodiment of the attracting body according to the invention.
Figure 2:
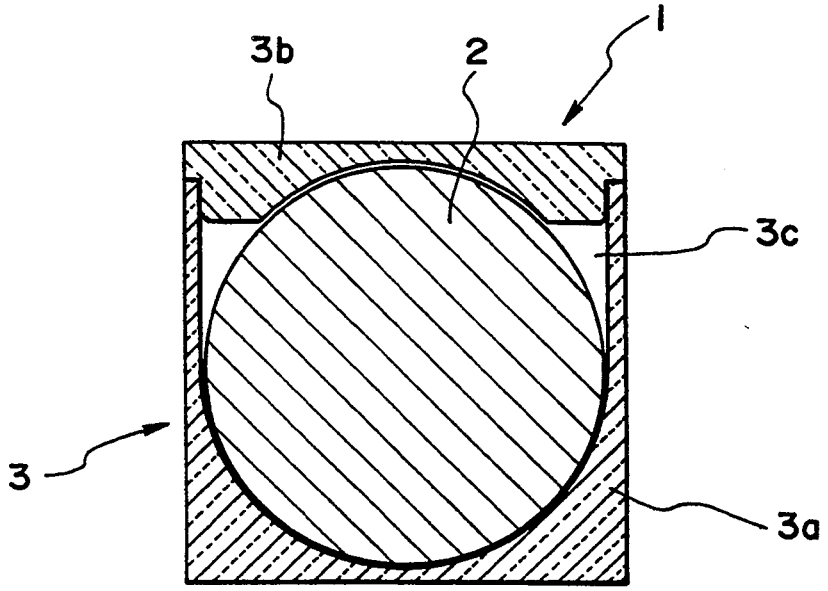
FIG. 2 is a sectional view showing the first embodiment of the attracting body according to the invention.

FIGS. 1 and 2 show a first embodiment of the attracting body according to the invention. Referring to the Figures, designated at 1 is the attracting body according to the invention. Designated at 2 is a spherical magnet body about 15 mm in diameter and having paired N and S poles formed in uni-axial direction. Designated at 3 is a transparent non-magnetic case made of acrylic acid or like synthetic resin. The case 3 comprises a case body 3*a* and a lid 3*b*. Its shape is a right hexahedron about 16.7 mm on one side, and it has a substantially spherical inner accommodation space 3*c* about 15.3 mm in diameter. In the accommodation space 3*c* of the case 3 is sealed a transparent liquid, like oil, which has a high specific gravity and a somewhat high viscosity to facilitate the rotation of the magnet body 2 with the a lubricating action and for providing buoyancy to the magnet body 2.

The magnet body 2 is suitably a permanent magnet having high remanence and coercive force. The clearance between the magnet body 2 and the wall surface of the accommodation space 3*c* is set to be so such as to permit smooth rotation of the magnet body 2.

As can be seen from FIG. 2, although the magnet body 2 is slightly smaller than the accommodation space 3*c*, the small clearance enables substantially concentric rotation of the magnet body in the space 3*c*. The case 3 is applicable to combination toys such as toy blocks, puzzles, etc. and various attracting articles for mutual attraction. The thickness of the center portion of each side wall is set to be as small as about 0.7 mm to facilitate the mutual attraction of magnet bodies.

Figure 3:
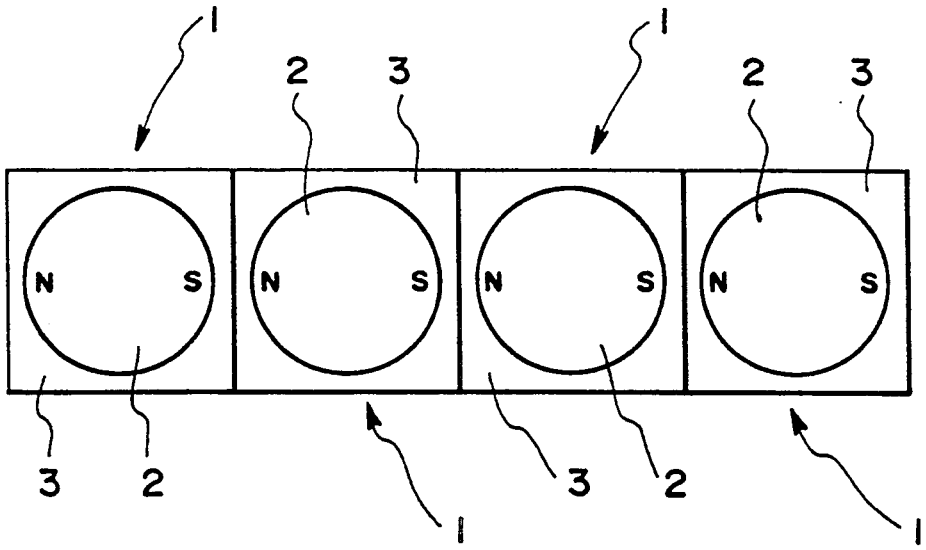
FIG. 3 is a front view showing a plurality of attracting bodies according to the invention in a state of mutual attraction to one another.

When a plurality of attracting bodies 1 having the above structure are brought close to one another to arrange them in a row, the magnet bodies 2 of the individual attracting bodies 1, initially oriented with their N and S poles directed in random directions, are rotated such that adjacent attracting bodies 1 provide a mutual pair of N and S poles. More specifically, the N and S poles are aligned in one direction, as shown in FIG. 3.

Figure 4:
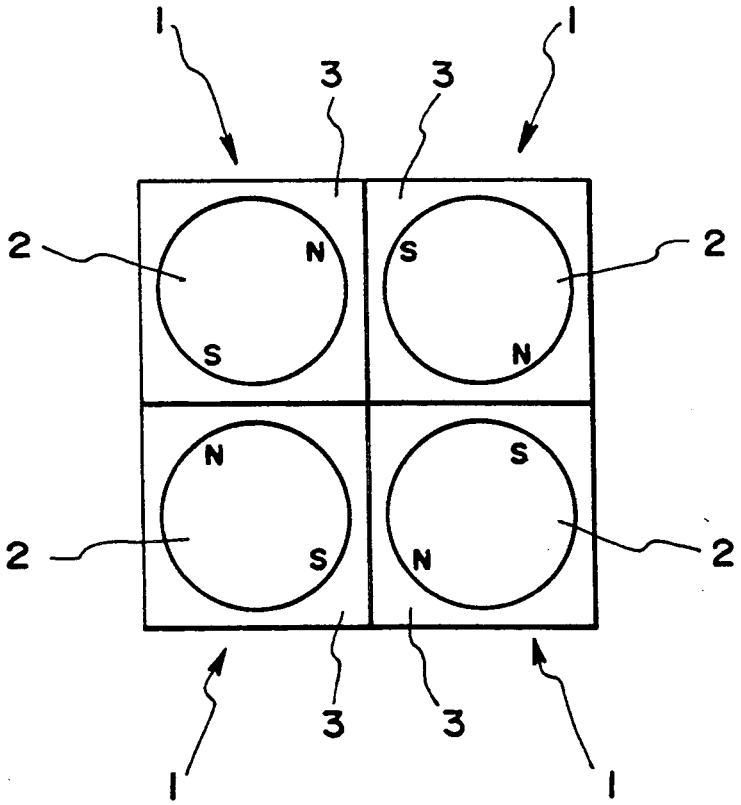
FIG. 4 is a front view showing a plurality of attracting bodies according to the invention in a state of mutual attraction to one another.

Further, when four attracting bodies 1 according to the invention, for instance, are stacked to obtain a square elevational view as shown in FIG. 4, the magnet bodies 2 of the individual attracting bodies, initially oriented with their N and S poles directed in random directions, are again rotated such that adjacent attracting bodies 1 provide a mutual pair of N and S poles. Thus, the N and S poles are arranged alternately along a circle as shown.

Figure 5:
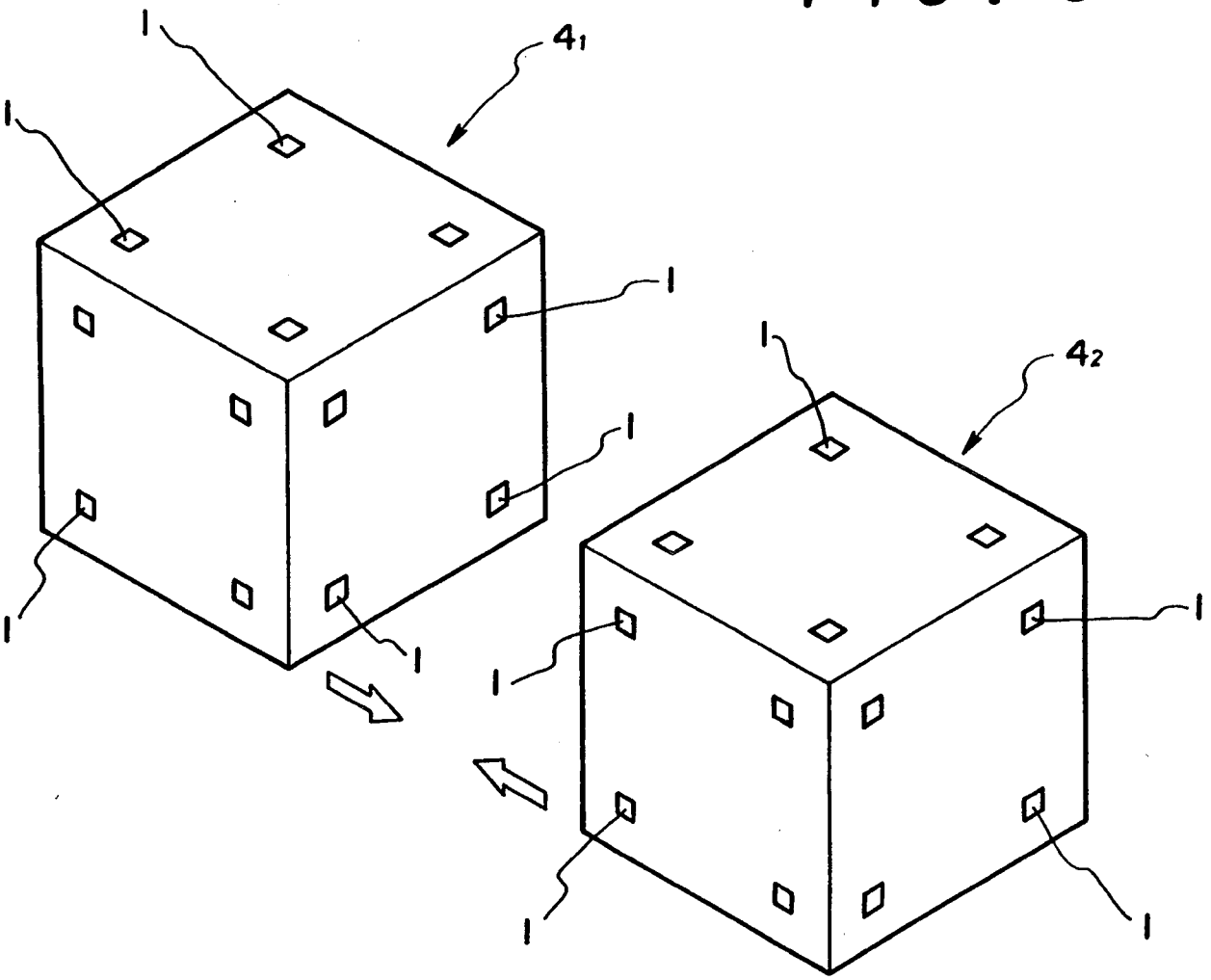
FIG. 5 is a perspective view showing an example of application of the attracting body according to the invention.

FIG. 5 shows an example of the application of the attracting body 1 to an attracting toy. The attracting body 1 is buried, with one side exposed, in each side of cubic bodies $4_1$ and $4_2$ near each corner of the side. When such cubic bodies $4_1$ and $4_2$ are brought close to each other, the attracting bodies 1 of these cubic bodies $4_1$ and $4_2$ attract one another with their magnet bodies providing mutual pairs of N and S poles. More specifically, the four attracting bodies 1 in one side of the cubic body $4_2$ can be readily brought into a mutually attracting relation with the four attracting bodies 1 in the opposed side of the other cubic body $4_2$ without need of matching the polarities of the individual magnet bodies. The above attracting body 1, in the form of the cubic box, can be utilized as combination toys such as toy blocks, puzzle sets, etc., various stacked accommodation boxes, temporary and permanent securing members such as large chests and small upper chests placed thereon and various other attracting articles, which can meet the requirements of mutual attraction. Of course, the attracting body need not be box-like, but it may be a frame or plate-like.

Figure 6:
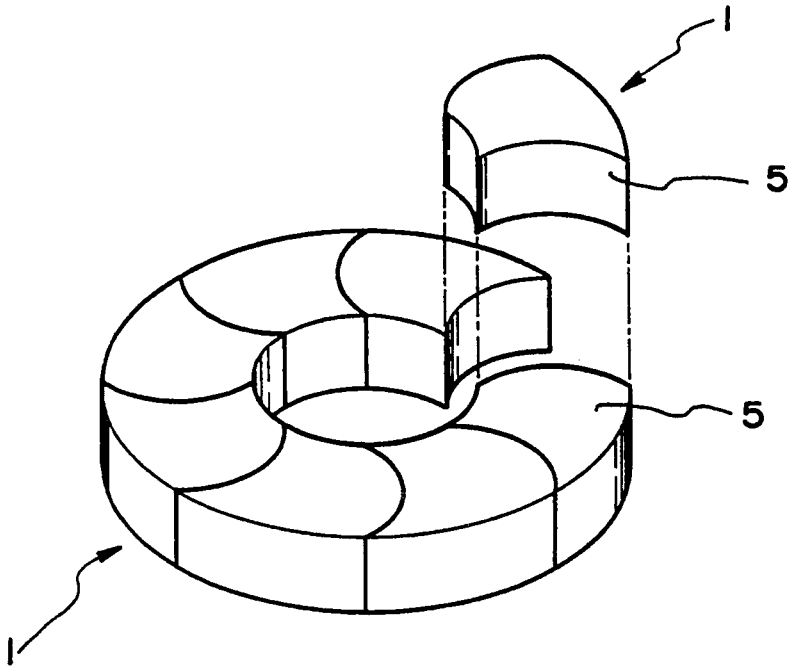
FIG. 6 is a perspective view showing a second embodiment of the attracting body according to the invention.

FIG. 6 shows a second embodiment of the attracting body according to the invention. In this instance, eight identical attracting bodies 1, each accommodating a magnet body (not shown), are assembled into a ring-like set 5. It will be seen that the attracting surfaces of the attracting bodies 1 are not limited to be plane but may be curved surfaces so long as they are complementary concave and convex surfaces adapted to be in close contact engagement with each other.

Figure 7:
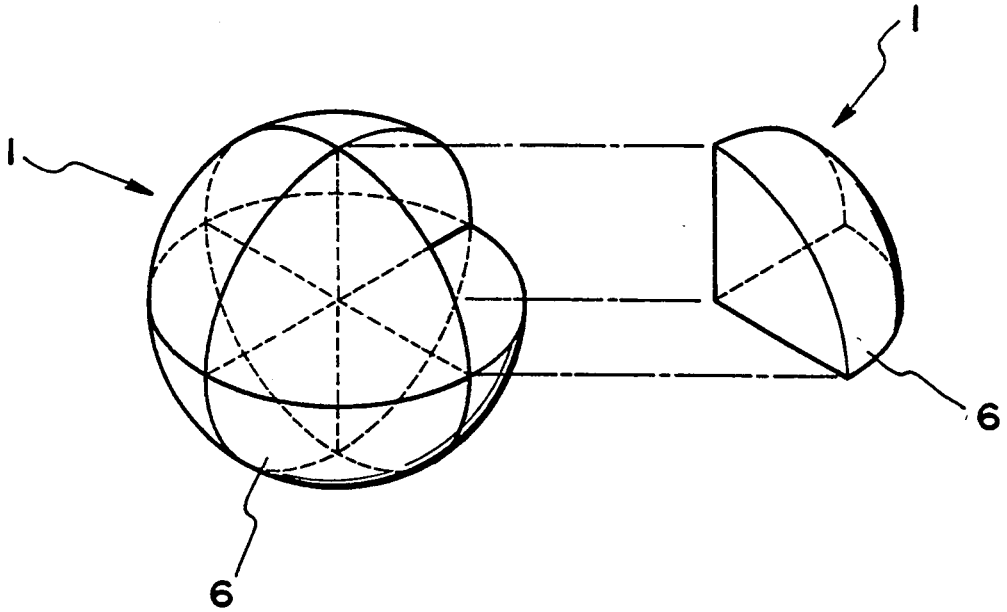
FIG. 7 is a perspective view showing a third embodiment of the attracting body according to the invention.

FIG. 7 shows a third embodiment of the attracting body 1 according to the invention. In this instance, eight identical attracting bodies 1, each accommodating a magnet body (not shown), are assembled into a spherical set 6.

The walls in the sets 5 and 6 to be attracted are provided with a reduced thickness portion to facilitate mutual attraction the magnets.

In the above embodiments, by coloring the N and S poles of the magnet body 2 with, for instance, red and yellow colors, a plurality of magnet bodies 2 with their pole orientation varying according to the magnetic fields set up by them can be visually recognized from the outside of their cases 3. Thus, it is possible to provide not only game-wise interest but also educational effects.

Further, if the case 3 is opaque, the strange magnet function of being attracted in any direction can be enjoyed. Further, by coloring the sides of the case 3 with different colors, the attracting body according to the invention can be employed for puzzle games.

While in the above embodiments the magnet body 2 was sealed together with a liquid in the accommodation space 3*c*, this is of course by no means limitative, and it is possible to fully attain the intended aim by sealing solely the magnet body.

As has been described, when a plurality of attracting bodies according to the invention are brought in to the vicinity of one another, they are attracted to one another with their N and S poles directed in the directions to be most easily attracted. That is, they can be attracted to one another independently of the magnet polarity and in any desired positional relation to one another. Thus, in the application of the attracting body according to the invention to combination toys such as toy blocks and puzzle sets or to various attracting articles meeting mutual attraction requirements, it is possible to obtain a sufficiently accurate attraction effect at a desired position as is required for these kinds of products which could not have heretofore been obtained by utilizing magnets.

Further, where the magnet body is sealed together with liquid in the case, the rotation of the magnet body can be promoted by the buoyancy and lubrication effects provided by the liquid. Further, the magnet body can be moved within the case without generating any abnormal sound.

Further, where a transparent case is used while providing the poles of the accommodated magnet body with peculiar indications such as different colors, a plurality of magnet bodies with their pole orientations varying according to the magnetic fields set up by them can be visually recognized from the outside of their cases, thus providing not only game-wise interest but also educational effects.

What is claimed is:

1. An attracting body comprising:

a case having at least two thin attracting surfaces, and a spherical accommodation space defined inside said case; and a spherical magnet body having paired N and S poles on a single axis of said spherical magnet body disposed in said spherical accommodation space, a clearance being defined between said spherical magnet body and said spherical accommodation space, and said spherical magnet body and said spherical accommodation space being substantially concentric for rotation of said spherical magnet body in said spherical accommodation space.

2. The attracting body of claim 1, wherein said spherical magnet body is sealed together with a liquid in said spherical accommodation space.

3. The attracting body of claim 2, wherein said case is transparent and said poles of said spherical magnet body are provided with different visual identifications.

4. The attracting body of claim 1, wherein said case is transparent and said poles of said spherical magnet body are provided with different visual identifications.

5. An apparatus, comprising:

a plurality of attracting bodies that are positionable and attractable to each other, each said attracting body comprising:

a case having at least two thin attracting surfaces, and a spherical accommodation space defined inside said case; and a spherical magnet body having paired N and S poles on a single axis of said spherical magnet body disposed in said spherical accommodation space, a clearance being defined between said spherical magnet body and said spherical accommodation space, and said spherical magnet body and said spherical accommodation space being substantially concentric for rotation of said spherical magnet body in said spherical accommodation space.

6. The apparatus of claim 5, wherein for each said attracting body, said spherical magnet body is sealed together with a liquid in said spherical accommodation space.

7. The apparatus of claim 6, wherein for each said attracting body, said case is transparent and said poles of said spherical magnet body are provided with different visual identifications.

8. The apparatus of claim 5, wherein for each said attracting body, said case is transparent and said poles of said spherical magnet body are provided with different visual identifications.

* * * * *